US007278172B2

(12) United States Patent
Shin

(10) Patent No.: US 7,278,172 B2
(45) **Date of Patent: *Oct. 9, 2007**

(54) SWEATBAND USING MICRO FIBER YARN FOR A CAP

(75) Inventor: Sung Su Shin, Kunpo (KR)

(73) Assignee: Dada Corp., Seoul (KR)

( * ) Notice: Subject to any disclaimer, the term of this patent is extended or adjusted under 35 U.S.C. 154(b) by 190 days.

This patent is subject to a terminal disclaimer.

(21) Appl. No.: 10/816,860

(22) Filed: Apr. 5, 2004

(65) Prior Publication Data

US 2005/0223472 A1 Oct. 13, 2005

(51) Int. Cl.
*A42B 5/00* (2006.01)

(52) U.S. Cl. ..... 2/181; 2/200.1

(58) Field of Classification Search ..... 2/181, 2/171, 200.1, 183, 184
See application file for complete search history.

(56) References Cited

U.S. PATENT DOCUMENTS 5,142,705 A 9/1992 Edward
5,915,534 A 6/1999 May
5,920,910 A 7/1999 Calvo
5,983,398 A 11/1999 Kronenberger
6,107,538 A * 8/2000 Young et al. ..... 604/369
6,817,035 B2 * 11/2004 Park ..... 2/181
6,928,659 B2 * 8/2005 Lee ..... 2/175.1
2004/0019954 A1 * 2/2004 Park ..... 2/195.1

* cited by examiner

*Primary Examiner*—Katherine Moran
*Assistant Examiner*—Richale L. Haney

(57) ABSTRACT

A sweatband using micro fiber yarn for headwear that is made to 0.5~1.05 denier thickness of micro fiber yarn and woven of 100% polyester warp-way and weft-way, made to single or two-ply without any polyurethane and additional stitched portion. The resulting sweatband, which preferably provides excellent sweat absorbing capability, and having high dryness factor, anti-static electricity function and the highly washable function, and exhibits good elasticity through the structure of the textile without imposing undue pressure on the wearer, with the result that the sweatband may be worn comfortably for long periods of time. The yarn used to produce the sweatband is processed by high temperature and piece dyeing methods and has twist per each certain length.

5 Claims, 2 Drawing Sheets

SWEATBAND USING MICRO FIBER YARN FOR A CAP

BACKGROUND OF THE INVENTION

1. Field of the Invention

The present invention is related to the field of headwear and, more particularly, to a sweatband which has high dryness factor and anti-static electricity function in addition to appropriate elasticity, and is highly washable and feel good to wear.

2. Description of the Prior Art

A typical baseball-style cap generally consists of crown main body which is main portion having one or more of sheets of panels, a visor portion which is attached to the bottom of front of said crown portion, a sweatband which is attached to under circular portion of inside of said crown and a size controller which is attached to under portion of rear side of said crown.

And said sweatband can be extended up to the rear side of said crown without the size controller having its own elasticity due to spandex yarn so as to be naturally fit for the wearer's head size when worn as the elastic sweatband is stretched.

It has been found, however, that caps relying on spandex sweatbands for sizing exert pressure against the wearer=s head which can become uncomfortable after the cap is worn for an extended period of time. In addition, the use of spandex yarn in such pre-existing sweatbands increases the cost of the cap.

It is, then, needed an improvement to feature comfortable feeling without pressure even when used for a long time in addition to having elasticity and reducing manufacturing cost.

SUMMARY OF THE INVENTION

In view of the foregoing, the object of the present invention is to provide the cap having sweatband giving comfortable feeling when it is worn as well as having elasticity.

Another object of the present invention is to provide a cap having the highly washable sweatband having high dryness factor, anti-static electricity function and appropriate elasticity.

To achieve these objects, the sweatband according to the present invention is mainly used for headwear and woven by properly arranging 100% polyester yarn, of which thickness limit is from 0.5~1.05 denier, as micro fiber yarn, warp-way and weft-way without the process of making additional stitching portion. And said sweatband does not contain polyurethane, is made to have elasticity as a whole as it has the effect to be stretched by the structure of the textile, the yarn composed of the sweatband is processed by high temperature method and piece dyeing method, and has the feature of having twist per each certain length. In addition, for using said sweatband to headwear, the sweatband can be applied both to the headwear necessary to have the elasticity of sweatband without additional size controller and to the headwear unnecessary to have the elasticity as it has the size controller.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
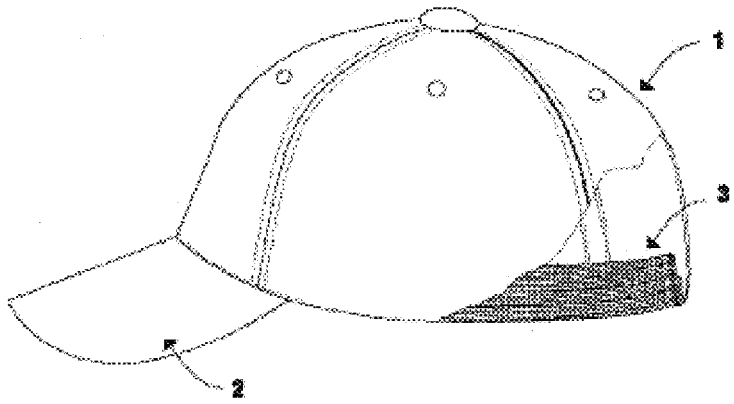
FIG. 1 is a sectioned side part view of the cap that the sweatband, which is made of micro fiber yarn, of the present invention is attached.

In describing preferred embodiments of the invention illustrated in the drawings, it is to be understood that these embodiments are given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

The present invention is directed to a sweatband suitable for use with headwear of various types, but is described herein in connection with a baseball-style cap as shown in FIG. 1. It is understood that the inventive sweatband may also be used with other types of headwear or even alone.

According to the embodiment illustrated in FIG. 1, the present invention is to the baseball-style cap comprising a crown main body 1 having one or more of sheets of panels, a visor portion 2 which is attached to the bottom of front of said crown portion, a sweatband 3 which is attached to under circular portion of inside of said crown. The sweatband 3 has the feature of being made of 0.5~1.05 denier of micro fiber yarn having no polyurethane and being woven by 1.04 denier of micro fiber yarn containing 100% polyester. When wearers wear the cap having said sweatband, they feel softer than the current one being naturally fit for the wearer's head size without additional size controller as the sweatband 3 is stretched. The sweatband 3 has also features of excellent sweat absorption, highly washable function, high dryness factor and anti-static electricity function.

Figure 2:
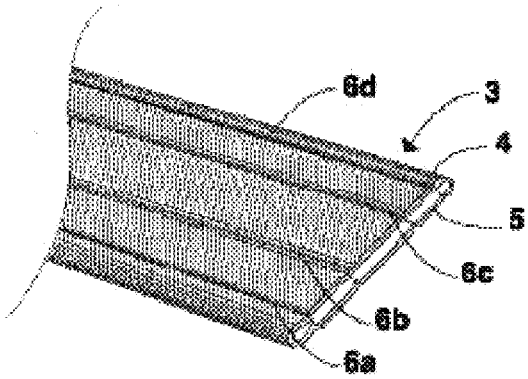
FIG. 2 is a perspective view of the sweatband of the present invention.

FIG. 2 is a perspective view of the sweatband of the present invention. As shown in FIG. 2, the sweatband 3 is woven in a cylinder two-ply 4, 5 shape without an additional stitched portion, and may be single ply or two-ply according to the woven shape with the resulting effect that the sweatband 3 is stretchable as a result of the structure of the textile. And there are 4 stitching lines 6*a*, 6*b*, 6*c*, 6*d* on the sweatband 3. The sweatband 3 is woven 150 D/144 yarn wrap-way with at least 2 or more of yarns and 450 D/432 yarn weft-way using 1.04 denier of micro fiber yarn, and has the feature of having twist per each certain length. The 150 D/144 yarn means that 144 ea of 1.04 denier micro fiber yarns comprises a strand of which thickness is 150 denier. As the foregoing descriptions, though the sweatband does not contain polyurethane, it is made to have elasticity having the effect to be stretched by the structure of the textile. While the thickness of the micro fiber yarn of the present embodiment is 1.04 denier, 0.5~1.05 denier may be used in real use. The sweatband 3 has a width that is preferably within the range of 25 mm to 70 mm and does not include or require an additional stitching portion. In addition to providing excellent sweat absorbing capability, the sweatband according to the present invention does not exert undue pressure such that the cap remains comfortable when worn for extended time periods. The yarn used to produce the sweatband is processed by a high temperature method and piece dyeing method, and has the feature of twist per each certain length.

Figure 3:
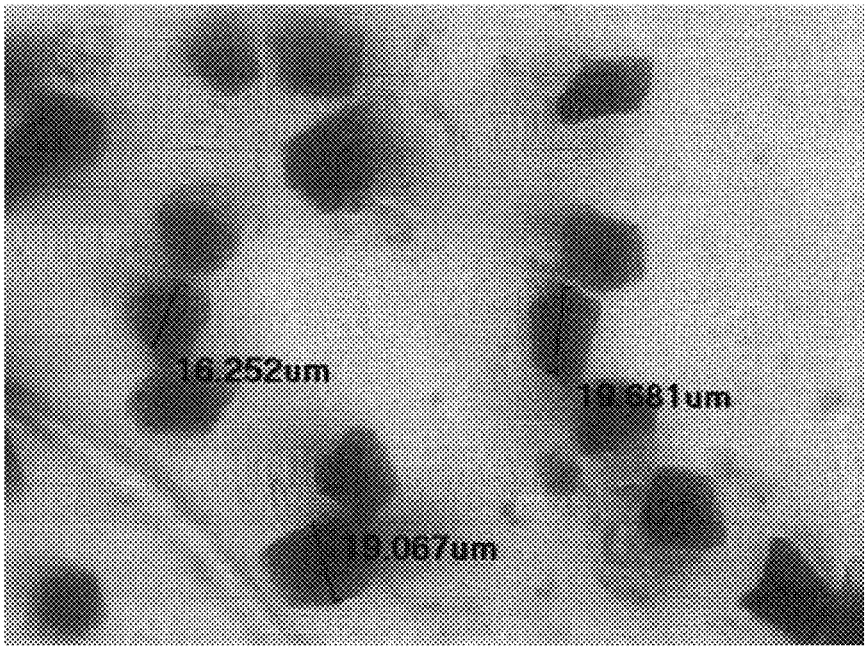
FIG. 3 is an enlarged sectional view of magnifying the micro fiber yarn comprising the sweatband of the present invention.

FIG. 3 is a sectioned view of magnifying a micro fiber among the sweatband of the present invention. As shown on FIG. 3, you may see 600× enlarged view of the sectional micro fiber yarn from the sweatband of the present invention containing 100% polyester. More or less big spots on the picture are the sectional portion of micro fiber yarn of which the thickness is measured 16.252 μm~19.681 μm.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the headband may be incorporated into hats, caps and visors of other styles, or may be used alone. Therefore, it is not desired to limit the invention to the specific examples disclosed or the exact construction and operation shown and described. Rather, all suitable modifications and equivalents may be resorted to, falling within the scope of the invention.

What is claimed is:

1. A sweatband using micro fiber yarn for headwear, said sweatband woven warp-way and weft-way with 100% polyester yarn containing no polyurethane, with a thickness of 0.5 to 1.05 denier, and said sweatband is woven in a tubular shape without and additional stitching portion.

2. The sweatband as set forth in claim 1, wherein the sweatband is two-ply.

3. The sweatband as set forth in claim 1, wherein said yarn is processed by high temperature and piece dying method.

4. Headwear Comprising: a crown body; a visor portion secured to a peripheral edge of said crown main body and extending outwardly there from; and a sweatband woven in tubular shape and attached along said lower peripheral edge of said crown main body, said sweatband woven warp-way and weft-way with 100% polyester, micro fiber yarn having a thickness of 0.5 to 1.05 denier.

5. The headwear as set forth in claim 4, wherein said yarn is processed by high temperature and piece dying methods.

* * * * *